US009963813B2

(12) United States Patent
Kuramashi et al.

(10) Patent No.: US 9,963,813 B2
(45) Date of Patent: May 8, 2018

(54) PRESSER LIFTING MECHANISM OF A SEWING MACHINE

(71) Applicant: JUKI CORPORATION, Tokyo (JP)

(72) Inventors: Daishi Kuramashi, Tokyo (JP); Atsushi Shiraishi, Tokyo (JP); Tsuyoshi Hanada, Tokyo (JP); Kazuhiro Mitani, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 57 days.

(21) Appl. No.: 15/266,112

(22) Filed: Sep. 15, 2016

(65) Prior Publication Data

US 2017/0073865 A1 Mar. 16, 2017

(30) Foreign Application Priority Data

Sep. 16, 2015 (JP) ..... 2015-182813

(51) Int. Cl.
*D05B 29/06* (2006.01)
*D05B 29/02* (2006.01)

(52) U.S. Cl.
CPC ..... *D05B 29/06* (2013.01); *D05B 29/02* (2013.01)

(58) Field of Classification Search
None
See application file for complete search history.

(56) References Cited

U.S. PATENT DOCUMENTS 4,455,956 A * 6/1984 Yamamoto ..... D05B 21/00 112/274
4,587,911 A * 5/1986 Kinoshita ..... D05B 29/00 112/239
4,676,179 A * 6/1987 Nomura ..... D05B 29/02 112/239
5,092,257 A * 3/1992 Ogawa ..... D05B 87/02 112/225
5,687,659 A * 11/1997 Matsunaga ..... D05B 29/02 112/239
6,382,118 B1 * 5/2002 Wolf ..... D05B 29/02 112/239
2008/0196646 A1 8/2008 Makino et al.

FOREIGN PATENT DOCUMENTS

JP 2008-200311 A 9/2008

* cited by examiner

*Primary Examiner* — Danny Worrell
(74) *Attorney, Agent, or Firm* — Drinker Biddle & Reath LLP

(57) ABSTRACT

The presser lifting mechanism of a sewing machine includes a cloth presser, a pressing rod which holds the cloth presser by a bottom end portion thereof, a rod holder which is fixed to the pressing rod, a pressing spring a bottom end portion of which is in contact with a top end portion of the rod holder and which pushes the cloth presser downward via the rod holder, a push-up member through which the pressing rod is inserted so as to be movable in the vertical direction and which is in contact with the rod holder from below and can pushed it up, a link body which is in contact with a bottom surface of the rod holder and is connected to the push-up member, and a presser motor which is linked to the link body and serves as a drive source for elevation and lowering of the cloth presser.

9 Claims, 14 Drawing Sheets

PRESSER LIFTING MECHANISM OF A SEWING MACHINE

CROSS-REFERENCE TO RELATED APPLICATION

The present application claims the benefit of priority of Japanese Patent Application No. 2015-182813 filed on Sep. 16, 2015, the disclosure of which is incorporated herein by reference.

TECHNICAL FIELD

The present invention relates to a presser lifting mechanism of a sewing machine which elevates and lowers a cloth presser.

BACKGROUND ART

Cloth pressers of sewing machines press, from above, by spring pressure, a sewing object placed on a sewing plate and thereby secure necessary contact pressure between the sewing object and feed teeth that emerge from below the sewing plate and sink to below it. With this structure, as the thickness of a sewing object increases, the cloth presser comes to crush the sewing object to possibly disable proper feeding of the sewing object.

A sewing machine for solving the above problem is known (refer to JP-A-2008-200311, for example). This sewing machine is equipped with a pulse motor as a drive source for elevating and lowering a pressing rod, a rack-formed member which is fitted with a top end portion of the pressing rod so as to be able to be elevated and lowered, a pinion gear which is in mesh with the rack-formed member and is rotated by the pulse motor, a stop ring which is fixed to the top end of the pressing rod, a pressing rod holder which is fixed to a middle portion, in the height direction, of the pressing rod, and a pressing spring through which the pressing rod is inserted between the rack-formed member and the pressing rod holder. The pressing rod is elevated or lowered by driving the pinion gear by the motor. A small presser lifting function is provided which enables proper feeding of a thick sewing object by performing a control of lifting up the cloth presser to a position (small presser lift height) that is somewhat above the needle plate.

However, in the above conventional sewing machine, the compression of the pressing spring which is disposed between the rack-formed member and the pressing rod holder is canceled when the rack-formed member is elevated by rotation of the pinion gear. Thus, the cloth presser exerts no pressing pressure on a sewing object when the small presser lifting function of having the presser lifted above the needle plate by 0 to 2.5 mm is performed.

The cloth presser exerting no pressing pressure on a sewing object raises, for example, a problem that where the sewing object is a stack of two cloths, the lower cloth is moved (fed) a much longer distance by the feed teeth than the upper cloth to produce a deviation between them.

SUMMARY OF THE INVENTION

An object of the present invention is to provide a presser lifting mechanism that enables proper feeding of a sewing machine even for a thick sewing object. The present invention has features described in the following items (1)-(9).

Means for Solving the Problem (1) A presser lifting mechanism of a sewing machine comprising:

a cloth presser;

a pressing rod which is supported by a machine frame so as to be movable in the vertical direction and holds the cloth presser by a bottom end portion thereof;

a rod holder which is fixed to the pressing rod; and a pressing spring a bottom end portion of which is in contact with a top end portion of the rod holder and which pushes the cloth presser downward via the rod holder;

a push-up member through which the pressing rod is inserted so as to be movable in the vertical direction and which is in contact with the rod holder from below and can pushed it up;

a link body which is in contact with a bottom surface of the rod holder and is connected to the push-up member; and a presser motor which is linked to the link body and serves as a drive source for elevation and lowering of the cloth presser, wherein:

the presser motor exerts only elevating force to the rod holder via the link body and causes the push-up member to follow elevation of the rod holder via the link body.

(2) The presser lifting mechanism of a sewing machine according to item (1), further comprising:

a motor control unit which controls the presser motor;

a presser height detection unit which detects a height of the cloth presser from a top surface of a needle plate on which a sewing object is placed; and a setting input unit which sets a height of the cloth presser from the top surface of the needle plate, wherein:

the motor control unit controls the presser motor so that the cloth presser comes to be located at the height that is set by the setting input unit.

(3) The presser lifting mechanism of a sewing machine according to item (2), wherein the setting input unit sets a small presser lift height at which a gap is formed between the cloth presser and the top surface of the needle plate.

(4) The presser lifting mechanism of a sewing machine according to item (2) or (3), wherein the presser height detection unit comprises:

a detection member which is supported by the push-up member;

a detection gear which rotates as the detection member is moved in the vertical direction; and an encoder which detects a rotation mount of the detection gear.

(5) The presser lifting mechanism of a sewing machine according to any one of items (2) to (4), further comprising a manual lever which lifts up the cloth presser when swing-manipulated, wherein:

the manual lever is formed with a fitting portion which is fitted with a fitting counterpart portion formed in the rod holder or the push-up member when the cloth presser is lifted up to a presser lift position escape which is an escape position of the cloth presser above the needle plate.

(6) The presser lifting mechanism of a sewing machine according to item (5), wherein:

the fitting portion of the manual lever is fitted with the fitting counterpart portion of the rod holder or the push-up member from below;

the manual lever can swing because of its own weight in a direction in which its center of gravity moves downward when the fitting between the fitting portion and the fitting counterpart portion is canceled because of an upward movement of the rod holder or the push-up member; and the motor control unit performs a control of canceling the fitting between the fitting portion and the fitting counterpart portion by moving the push-up member upward by driving the presser motor.

(7) The presser lifting mechanism of a sewing machine according to item (6), wherein the motor control unit performs a manual lever cancellation control of driving the presser motor in such a direction as to elevate the cloth presser to a position where the fitting between the fitting portion and the fitting counterpart portion is canceled if lowering of the cloth presser is not detected by the presser height detection unit when the presser motor is driven in such a direction as to lower the cloth presser after the cloth presser's being located at the presser lift position was detected by the presser height detection unit.

(8) The presser lifting mechanism of a sewing machine according to any one of items (5) to (7), further comprising an origin sensor which detects arrival or presence of the presser motor to or at an origin position where the cloth presser is located at a pressing position, wherein:

the motor control unit performs an automatic presser lift cancellation control of returning the presser motor to the origin position by driving it in such a direction as to lower the cloth presser if the presser height detection unit detects that the cloth presser is located above the presser lift position and the origin sensor detects that the presser motor is not located at the origin point.

(9) The presser lifting mechanism of a sewing machine according to any one of items (2) to (8), further comprising:

a knee lift lever which lifts up the cloth presser when swing-manipulated; and an origin sensor which detects arrival or presence of the presser motor to or at an origin position where the cloth presser is located at a pressing position, wherein:

the motor control unit performs an automatic presser lift cancellation control of returning the presser motor to the origin position by driving it in such a direction as to lower the cloth presser if the presser height detection unit detects that the cloth presser is located above the presser lift position and the origin sensor detects that the presser motor is not located at the origin point.

According to the present invention, since the presser motor exerts elevating force to the rod holder via the link body against the spring force of the pressing spring, the cloth presser can be placed at a desired position by controlling the driving of the presser motor.

In this connection, since the presser motor exerts only elevating force to the rod holder via the link body, the rod holder can be moved upward without being bound by the presser motor even when the presser motor is stopped.

If the cloth presser is lifted to above an adjustment height, the pressing force of the pressing spring acts on it. As a result, pressing pressure can be exerted on a sewing object with the cloth presser located at a desired height. Thus, the sewing machine gives proper feeds to the sewing object while suppressing a deviation of the sewing object.

DETAILED DESCRIPTION

[Outline of Machine Frame 100]

Figure 1:
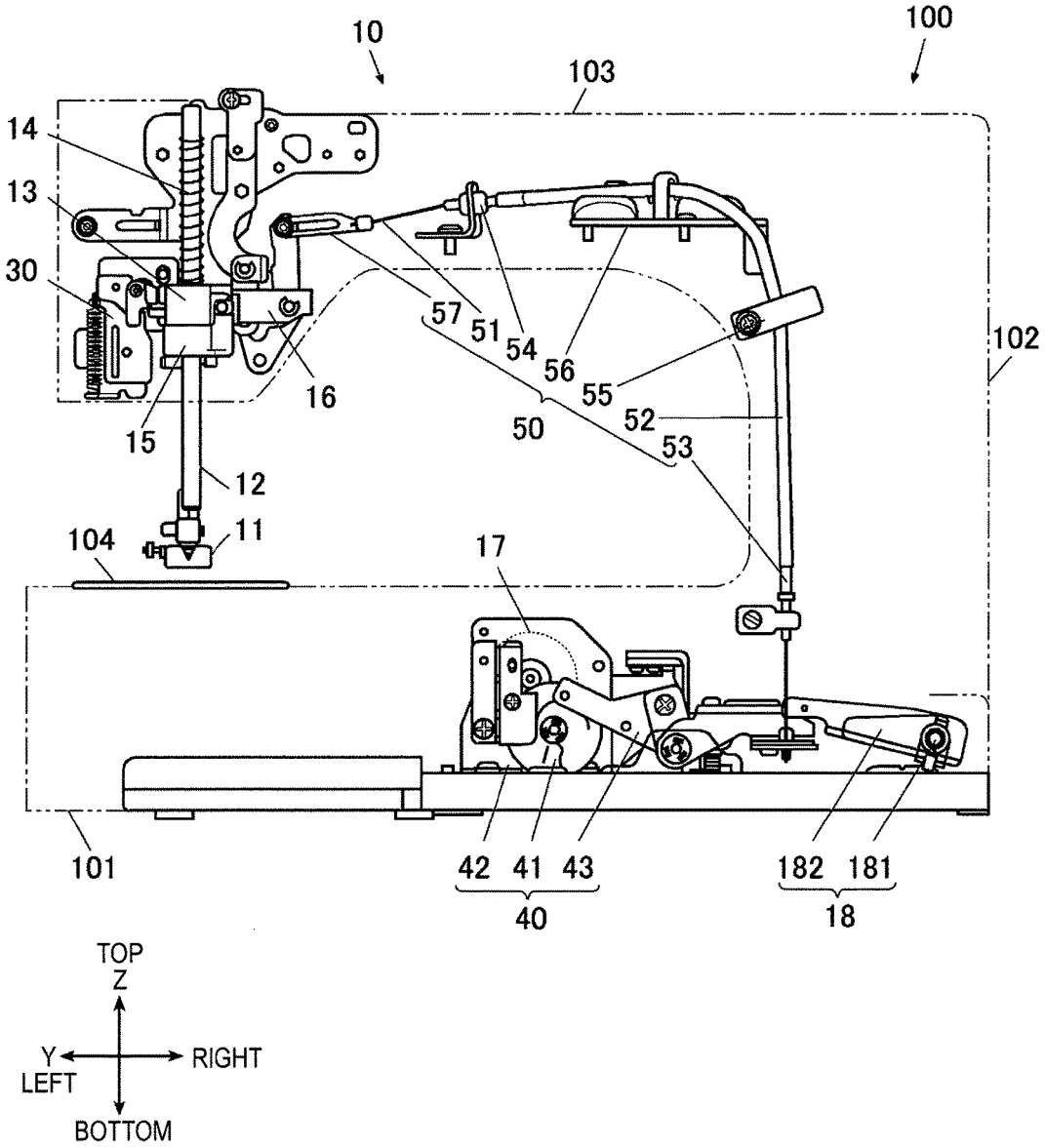
FIG. 1 is a front view of the overall configuration of a presser lifting mechanism which is disposed in a machine frame.

A presser lifting mechanism 10 according to the present invention will be hereinafter described with reference to the drawings. FIG. 1 is a front view of the overall configuration of the presser lifting mechanism 10 which is provided in a machine frame 100. In the following description, as shown in FIG. 1, the Y-axis direction is defined as a horizontal direction that is the longitudinal direction of a bed unit 101 of the machine frame 100, the X-axis direction is defined as a horizontal direction that is perpendicular to the Y-axis direction, and the Z-axis direction is defined as the vertical direction. If necessary, the left side and the right side of the Y-axis direction and the deep side and the viewer's side (with respect to the paper surface) of the X-axis direction are defined as shown in FIG. 1.

The machine frame 100 is composed of the machine bed unit 101, a vertical barrel unit 102 which is erected from a right end portion of the machine bed unit 101, and a machine arm unit 103 which extends leftward from a top end portion of the vertical barrel unit 102. A needle drop position exists in a left end portion of the machine bed unit 101, and the top surface of the left end portion is provided with a needle plate 104. A needle bar (not shown) is disposed in a left end portion of the machine arm unit 103 and supported so as to extend in the Z-axis direction and to be able to go up and down.

[General Configuration of Presser Lifting Mechanism 10]

The presser lifting mechanism 10 is equipped with a cloth presser 11, a pressing rod 12 which holds the cloth presser 11 by its bottom end portion, a rod holder 13 which is fixed to the pressing rod 12 at its intermediate position in the longitudinal direction, a pressing spring 14 which pushes the pressing rod 12 and the cloth presser 11 downward via the rod holder 13, a push-up member 15 which is supported so as to be able to go up and down relative to the machine frame 100 and is in contact with the rod holder 13 from below so as to be able to push it up, a bell-crank-shaped link body 16 for transmitting elevating force to the push-up member 15, a manual lever 20 for lifting up the cloth presser 11 to a presser lift position when swing-manipulated, a presser height detection unit 30 for detecting the height of the cloth presser 11, a presser motor 17 as a drive source for elevation of the cloth presser 11, a cam mechanism 40 for converting torque of the presser motor 17 into straight motion, a wire mechanism 50 for transmitting motive power from the cam mechanism 40 to the link body 16, a knee lift mechanism 18, and a control device 90 (see FIG. 11) for the presser motor 17.

[Cloth Presser 11 and Pressing Rod 12]

The cloth presser 11 is what is called a ship-shaped presser which has a flat bottom surface and is curved upward on the upstream side in the cloth feeding direction (i.e., on the viewer's side). The pressing rod 12 is supported by the machine arm unit 103 so as to extend in the Z-axis direction in the vicinity of the needle bar and to be able to go up and down.

[Rod Holder 13]

Figure 2:
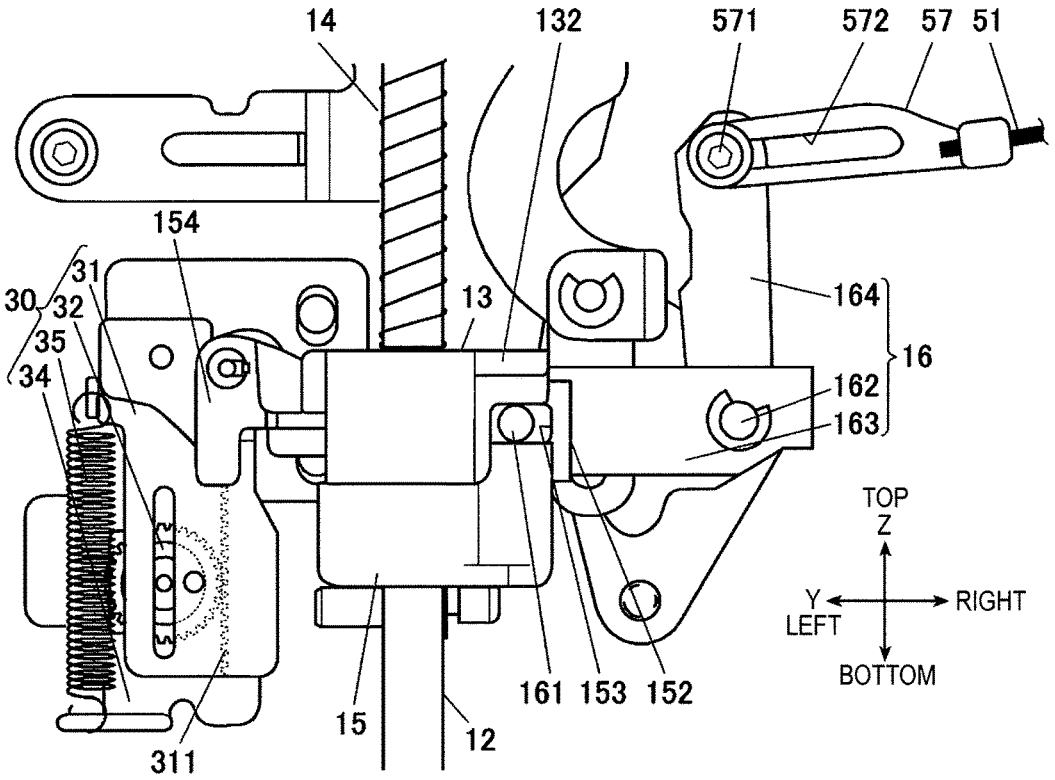
FIG. 2 is a front view showing the structures of a rod holder and components around it.
Figure 3:
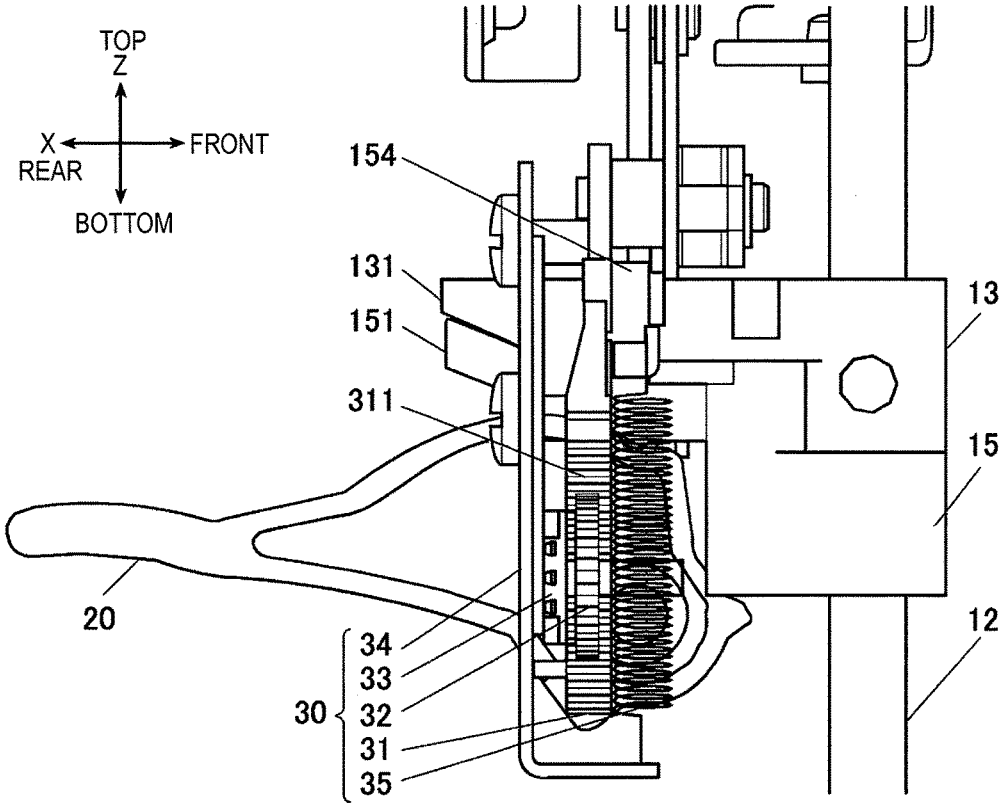
FIG. 3 is a left side view showing the structures of the rod holder and the components around it.
Figure 4:
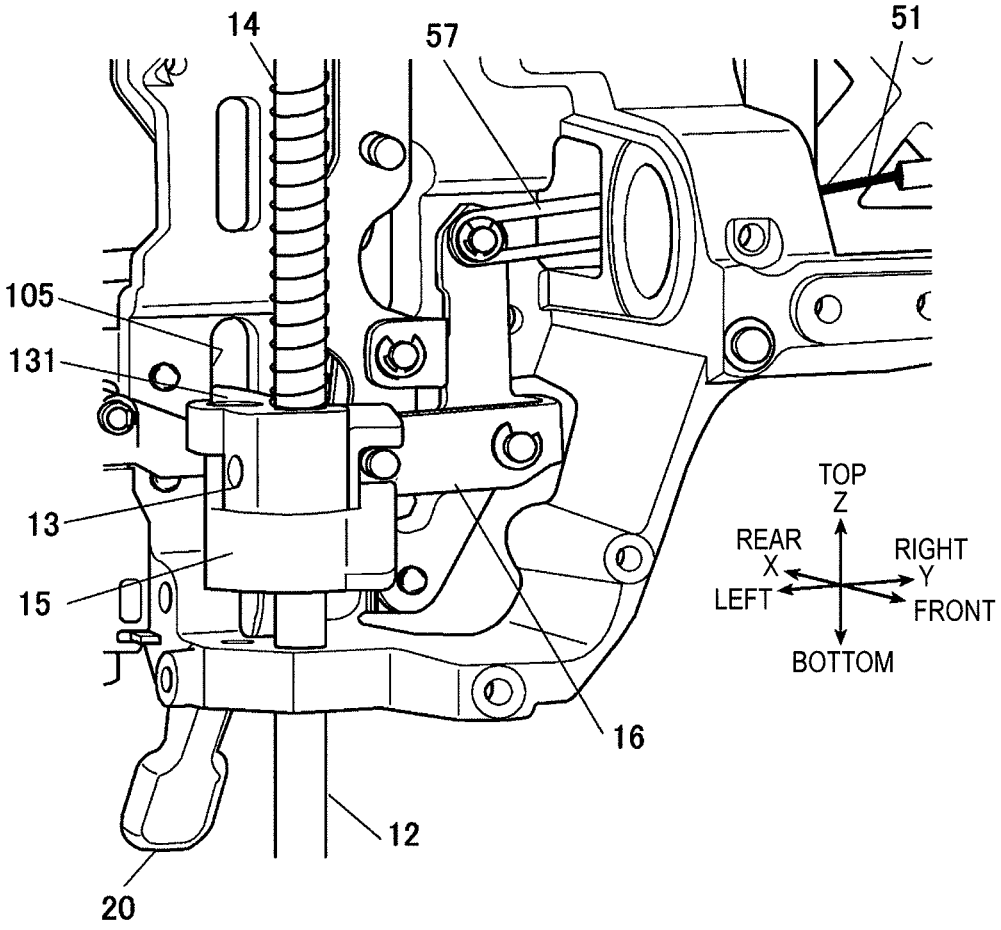
FIG. 4 is a perspective view showing the structures of the rod holder and the components around it.

FIGS. 2, 3, and 4 are a front view, a left side view, and a perspective view, respectively, showing the structures of the rod holder 13 and components around it. The rod holder 13 is a block-shaped member through which a through-hole is formed at a central position (the pressing rod 12 is inserted through the through-hole). A rotation stop arm 131 extends from the rod holder 13 outward, that is, toward the deep side. The rod holder 13 is fastened (fixed) to the pressing rod 12 by a fixing screw that is screwed from outside and reaches the pressing rod 12 which is inserted through the through-hole. The arm 131 is inserted through a long hole 105 which is formed in an inner wall of the machine arm unit 103 so as to extend in the Z-axis direction.

An extension 132 extends rightward from a top-right portion of the rod holder 13. The bottom surface of the extension 132 is in contact with a top portion of a boss 161 which extends toward the viewer's side from one swing end portion of the link body 16. Thus, when the link body 16 is swung, only upward motive power is transmitted to the rod holder 13.

The bottom end of the pressing spring 14 is in contact with the top surface of the rod holder 13, whereby downward pressing pressure is exerted on the cloth presser 11 via the rod holder 13 and the pressing rod 12. The top end of the pressing spring 14 is in pressure contact with an inner wall (not shown) of the machine arm unit 103, whereby the pressing spring 14 is kept compressed and hence always exerts pressing pressure on the cloth presser 11.

[Push-Up Member 15]

The push-up member 15 is a block-shaped member through which a through-hole is formed at a central position (the pressing rod 12 is inserted through the through-hole). A rotation stop arm 151 extends from the push-up member 15 outward, that is, toward the deep side. The push-up member 15 is not fixed to the pressing rod 12 and hence can go up and down relative to the pressing rod 12.

The push-up member 15 is disposed immediately under the rod holder 13. A top portion of the push-up member 15 is in contact with a bottom portion of the rod holder 13, and hence the push-up member 15 can push up the rod holder 13. Since the push-up member 15 is in contact with the rod holder 13 from below, the rod holder 13 is not prevented from going up separately from the push-up member 15.

The arm 151 of the push-up member 15 is the same in orientation and length as the arm 131 of the rod holder 13 when viewed from above, and is inserted in the above-mentioned long hole 105. As a result, the top surface of the arm 151 of the push-up member 15 is in contact with the bottom surface of the arm 131 of the rod holder 13 approximately over its entire length.

The manual lever 20 is in contact with the arm 151 of the push-up member 15 from below, and hence the push-up member 15 can be pushed up by the manual lever 20. A bottom portion of the arm 151 is formed with a slant surface 155 which is in contact with the manual lever 20 and a convex fitting counterpart portion 156 on which the manual lever 20 is to be locked. The fitting counterpart portion 156 is formed at the boundary between a horizontal bottom surface of the push-up member 15 and the slant surface 155 of the arm 151 (see FIGS. 8-10).

An extension 152 extends rightward from a top-right portion of the push-up member 15. A long hole 153 is formed through the extension 152 so as to extend in the Y-axis direction, and the above-mentioned boss 161 of the link body 16 is inserted in the long hole 153. The width of the long hole 153 in the Z-axis direction is approximately equal to or slightly greater than the diameter of the boss 161, and its width in the Y-axis direction is sufficiently greater than the diameter of the boss 161. As a result, when the link body 16 is swung, a displacement of the boss 161 in the Z-axis direction is transmitted to the push-up member 15 almost fully. When the link body 16 is swung clockwise in FIG. 2, the push-up member 15 is moved upward. When the link body 16 is swung counterclockwise in FIG. 2, the push-up member 15 is moved downward.

A displacement of the boss 161 in the Y-axis direction that occurs when the link body 16 is swung is not transmitted to the push-up member 15 and does not interfere with the swing of the link body 16.

A link portion 154 extends leftward from an intermediate portion of the arm 151 of the push-up member 15. The link portion 154 holds a detection member 31 of the presser height detection unit 30. That is, the presser height detection unit 30 detects the height of the cloth presser 11 via the push-up member 15.

[Link Body 16]

The link body 16, which is what is called a bell crank, is supported by a support shaft 162 extending in the X-axis direction so as to be swingable relative to the frame in the machine arm unit 103.

The link body 16 has two swing arms 163 and 164 which extend approximately leftward and upward, respectively, from around the support shaft 162. The above-mentioned boss 161 projects toward the view's side from a tip portion of the one swing arm 163, and the wire mechanism 50 is connected to a tip portion of the other swing arm 164.

The swing arm 164 is given rightward tension from the presser motor 17 via the wire mechanism 50, whereby the link body 16 is swung clockwise (in FIG. 2) as a whole. As a result, the other swing arm 163 is also swung clockwise and thereby moves the push-up member 15 upward via the boss 161.

The presser motor 17 swings the link body 16 via a wire 51 of the wire mechanism 50, and the wire 51 cannot transmit pushing force satisfactorily though it can transmit tension satisfactorily. Thus, although it is almost impossible to give the link body 16 pushing force for swinging it counterclockwise using the presser motor 17, it is possible to lower the push-up member 15 by driving the presser motor 17 in this direction because the push-up member 15 is pushed downward by the pressing spring 14 via the rod holder 13.

[Presser Height Detection Unit 30]

The presser height detection unit 30 is equipped with the detection member 31 which is supported by the link portion 154 of the push-up member 15, a detection gear 32 which is rotated by vertical motion of the detection member 31, an encoder 33 for detecting the rotation amount of the detection gear 32, a holding plate 34 which holds the encoder 33 and is fixed to the frame of the machine arm unit 103, and a fixing spring 35 for suppressing a shake and play of the detection member 31.

The detection member 31 is formed with a rack gear 311 which extends in the vertical direction and is in mesh with the detection gear 32. With the above structure, the detection gear 32 is rotated in proportion to the vertical displacement of the detection member 31.

The detection gear 32 is attached to a detection shaft of the encoder 33. Thus, a variation of the vertical position of the cloth presser 11 can be detected by the encoder 33 via the push-up member 15.

The origin position of the encoder 33 is predetermined and a variation from the origin position can be detected. Thus, by acquiring a relationship between the origin position and the height of the cloth presser 11 in advance, a position of the cloth presser 11 can be detected from a detection value of the encoder 33. The encoder 33 may be of either an increment type or an absolute type.

As described above, the push-up member 15 and the rod holder 13 can be separated from each other in the vertical direction and the push-up member 15 is not fixed to the pressing rod 12. Thus, in a state of a small presser lift, the push-up member 15 is kept at a set height irrespective of a vertical movement of the pressing rod 12 due to feeding by the feed teeth during a sewing operation, a cloth thickness, etc. Since the rod holder 13 is always pushed toward the push-up member 15 by the pressing spring 14, pressing pressure of the pressing spring 14 can act on the push-up member 15 even in a state of a small presser lift. Furthermore, since the rod holder 13 is always pushed toward the push-up member 15 by the pressing spring 14, the presser height detection unit 30 can detect the height of the cloth presser 11 via the push-up member 15 unless, for example, the cloth presser 11 is pushed up against the pushing force of the pressing spring 14 by external force.

[Cam Mechanism 40]

Figure 5:
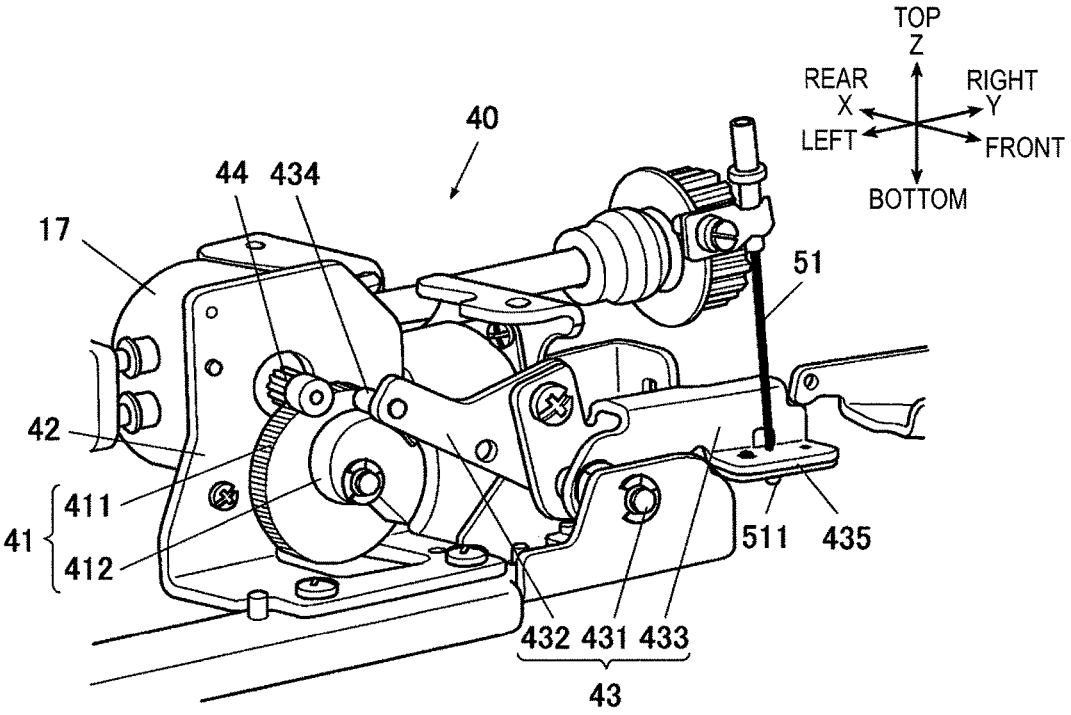
FIG. 5 is a perspective view of a cam mechanism and components around it.
Figure 6:
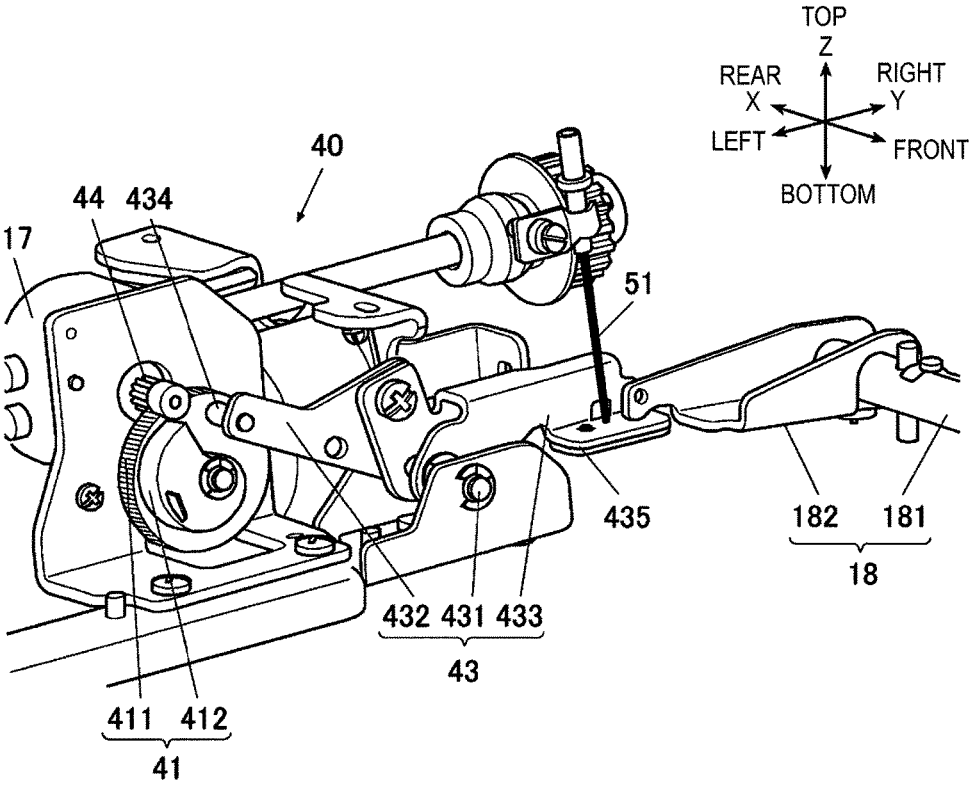
FIG. 6 is another perspective view of the cam mechanism and the components around it.

FIGS. 5 and 6 are perspective views of the cam mechanism 40. The cam mechanism 40 is mainly composed of a cam member 40, a support plate 42 which supports the cam member 41 so that the cam member 41 can rotate about the X axis in the machine bed unit 101, and a transmission link 43 which is supported swingably about the X axis in the machine bed unit 101.

The cam member 41 has a gear 411 whose outer circumferential surface is formed with teeth that are in mesh with a pinion gear 44 which is attached to an output shaft of the motor 17, whereby the cam member 41 is given torque from the presser motor 17.

One surface of the gear 411 is formed with a peripheral cam 412 which is smaller than the teeth-formed outer circumferential of the gear 411. The peripheral cam 412 is formed in such a manner that a maximum-diameter end portion comes when the peripheral cam 412 is rotated by 360° starting from a minimum-diameter origin portion, and that its diameter increases gradually clockwise (in FIG. 5).

The transmission link 43, which is what is called a bell crank, is supported by a support shaft 431 extending in the X-axis direction so as to be swingable relative to the frame in the machine bed unit 101.

The transmission link 43 is equipped with two swing arms 432 and 433 which extend approximately up leftward and rightward, respectively, from around the support shaft 162. A roller 434 is attached rotatably to a tip portion of the one swing arm 432, and the wire mechanism 50 is connected to a tip portion of the other swing arm 433.

The swing arm 432 supports the roller 434 so that it is rotatable about the X axis, and the roller 434 is in contact with the peripheral cam 412 of the cam member 41. One end of a tension spring (not shown) for bringing the roller 434 into pressure contact with the peripheral cam 412 is connected to the swing arm 432.

For example, when the cam member 41 is rotated counterclockwise from a state that the roller 434 is in contact with the minimum-diameter origin portion of the peripheral cam 412, the roller 343 which is in contact with the peripheral cam 412 from above is pushed up gradually. In this manner, a swing end portion of the swing arm 433 of the transmission link 43 can be swung downward gradually.

The swing end portion of the swing arm 433 is formed with a flat portion 435 through which a narrow through-hole is formed perpendicularly. The wire 51 of the wire mechanism 50 is inserted loosely through the through-hole from above, and a bottom end portion of the wire 51 is provided with a stopper 511 for preventing the wire 51 from coming off the through-hole.

With the above structure, when the swing arm 433 is swung clockwise about the support shaft 431, it can pull the wire 51 downward. By pulling the wire 51 downward, the above-mentioned link body 16 can be swung clockwise (in FIG. 2) and hence the cloth presser 11 can be elevated.

Although the swing arm 433 can pull the wire 51 downward because of the presence of the stopper 511, it cannot move the wire 51 upward that is inserted loosely through the through-hole even if it is swung counterclockwise.

[Knee Lift Mechanism 18]

As shown in FIGS. 1 and 6, the knee lift mechanism 18 is disposed adjacent to the cam mechanism 40. The knee lift mechanism 18 is equipped with a knee lift lever (not shown) to be manipulated by a knee to elevate the cloth presser 11, a support shaft 181 which supports the knee lift lever, and an output arm 182 which is fixed to the support shaft 181 and is swung together with the knee lift lever.

The knee lift lever is supported so as to hang down from a bottom surface, in the vicinity of a right end portion, of the machine bed unit 101, and is disposed so as to be able to be swing-manipulated by a knee of an operator of the sewing machine. The knee lift lever is manipulated so that its bottom end portion is swung rightward. The support shaft 181, which extends in the X-axis direction, is supported swingably in the machine bed unit 101 and swung together with the knee lift lever.

The output arm 182 extends leftward from the support shaft 181 in the machine bed unit 101. When the knee lift lever is swing-manipulated, a swing end portion of the output arm 182 is swung downward. The flat portion 435 of the transmission link 43 of the cam mechanism 40 is disposed under the swing end portion of the output arm 182.

With the above structure, when the knee lift lever is swing-manipulated rightward by the knee, the swing end portion of the output arm 182 can push down the flat portion 435 of the transmission link 43. Since the wire 51 is thus pulled down, the cloth presser 11 can be elevated.

The transmission link 43 of the cam mechanism 40 is swung by swing-manipulating the knee lift lever. However, since the cam member 41 of the cam mechanism 40 employs the peripheral cam 412, as shown in FIG. 6 this operation merely causes an event that the roller 434 is separated from the peripheral cam 412 and does not interfere with an operation of the cam mechanism 40.

[Wire Mechanism 50]

As shown in FIG. 1, the wire mechanism 50 is equipped with the wire 51 which links the swing end portion of the swing arm 433 of the transmission link 43 of the cam mechanism 40 to the tip portion of the swing arm 164 of the link body 16, a tube 52 through which the wire 51 is inserted, wire introduction pipes 53 and 54 which are attached to the two respective ends of the tube 52, guides 55 and 56 for the tube 52, and a link member 57 which links one end portion of the wire 51 to the tip portion of the swing arm 164.

The tube 52 is supported by the introduction pipes 53 and 54 and the guides 55 and 56, and can guide the wire 51 so that the wire 51 is routed properly from the swing arm 433 of the transmission link 43 to the swing arm 164.

Sliding in the tube 52, the wire 51 can transmit tension that is given at its end adjacent to the swing arm 433 of the transmission link 43 to its end adjacent to the swing arm 164 of the link body 16.

As shown in FIG. 2, the link member 57 is connected to the tip portion of the swing arm 164 of the link body 16 via a support shaft 571 which extends in the X-axis direction, and is swingable about the support shaft 571 relative to the swing arm 164. The link member 57 is long in the Y-axis direction, and the one end portion of the wire 51 is connected to a right end portion of the link member 57. A long hole 572 extending in the Y-axis direction is formed through the link member 57, and the support shaft 571 is inserted through the long hole 572. Thus, the link member 57 can be moved relative to the swing arm 164 in the Y-axis direction, that is, along an extension of the wire 51.

As described later, when the push-up member 15 is moved upward by the manual lever 20, the link body 16 is swung clockwise (in FIG. 2). At this time, since the support shaft 571 is moved rightward along the long hole 572 and hence the rightward displacement due to the swing of the swing arm 164 is not transmitted to the link member 57 and the wire 51.

[Manual Lever 20]

Figure 7:
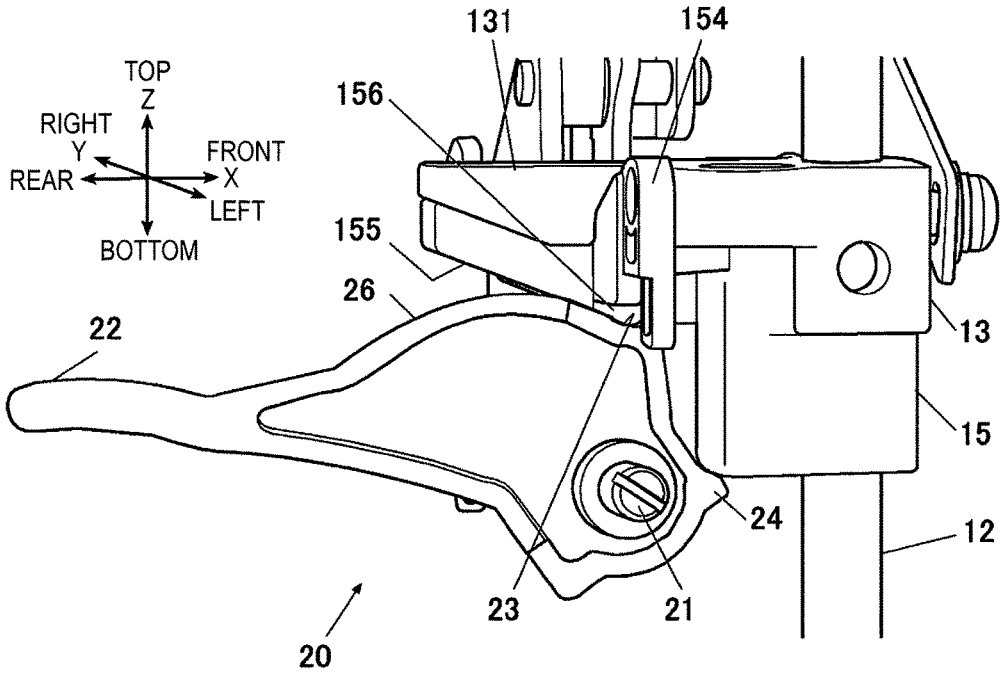
FIG. 7 is a perspective view of a manual lever and components around it.
Figure 8:
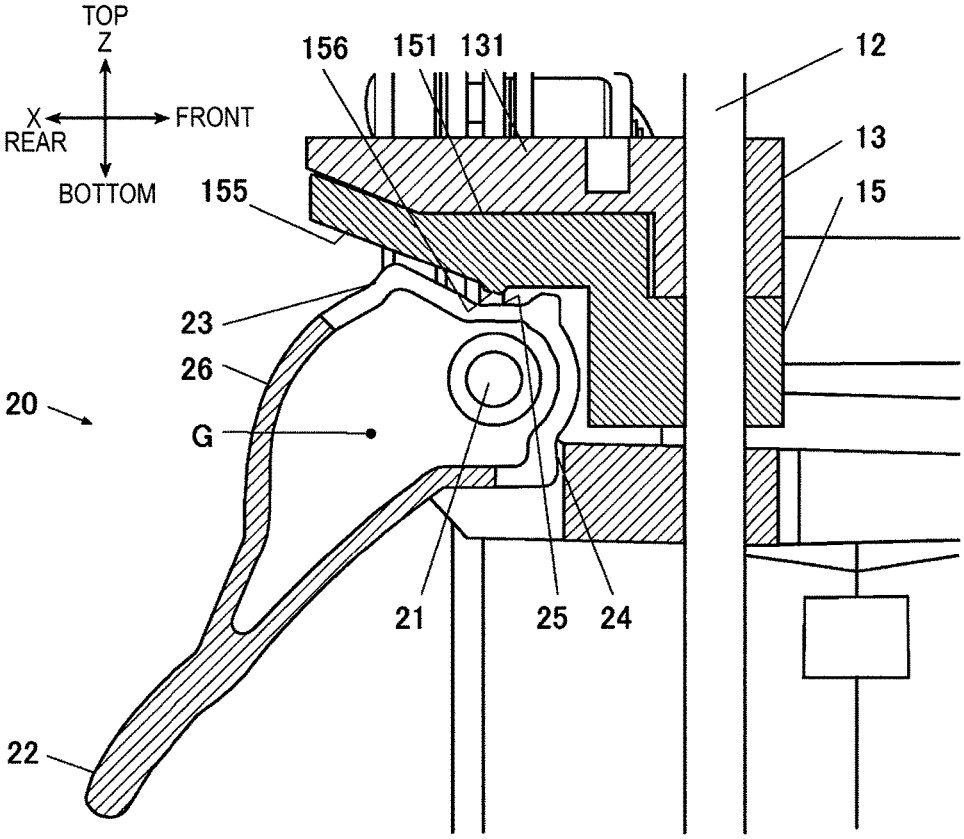
FIG. 8 is a diagram illustrating how the manual lever is used.
Figure 9:
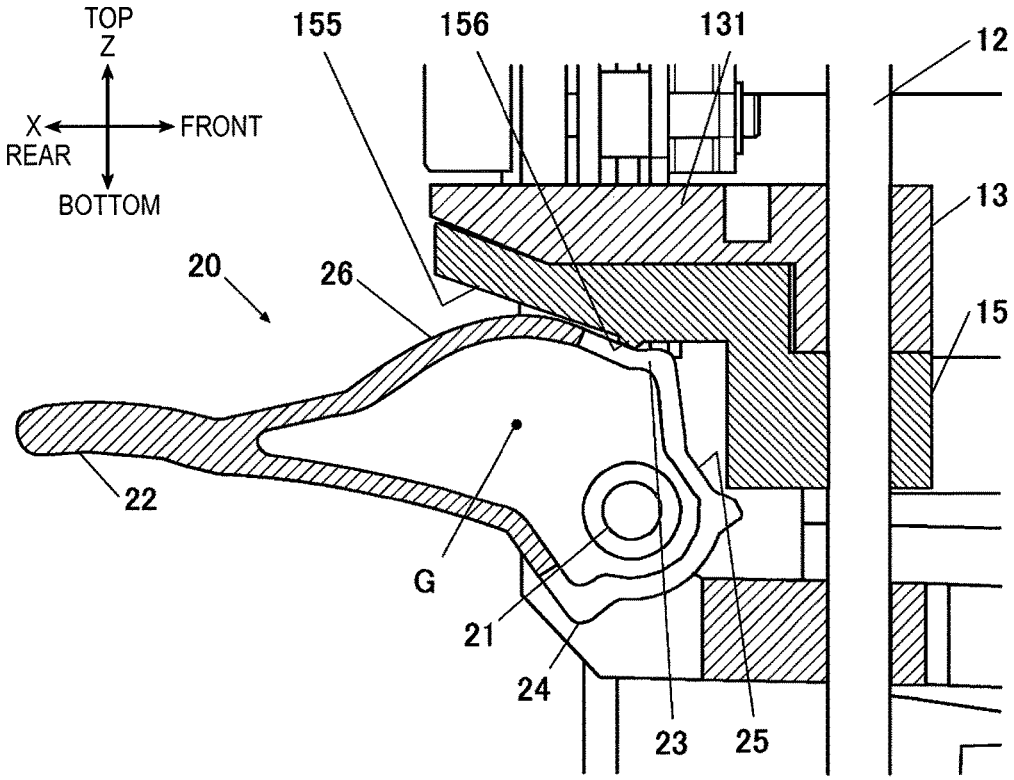
FIG. 9 is another diagram illustrating how the manual lever is used.
Figure 10:
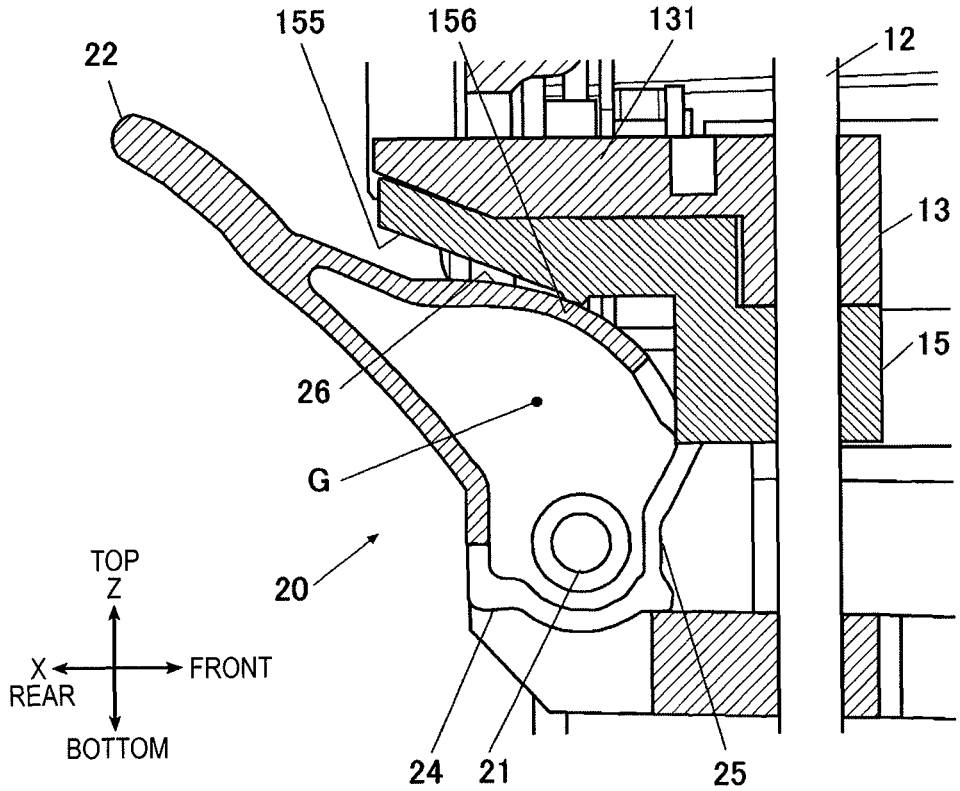
FIG. 10 is a further diagram illustrating how the manual lever is used.

FIG. 7 is a perspective view of the manual lever 20 and components around it. FIGS. 8-10 illustrate how the manual lever 20 is used.

The manual lever 20 is supported swingably by the frame of the machine arm unit 103 via the support shaft 21 which extends in the X-axis direction. A swing manipulation is made manually on an input arm 22 which extends outward in the radial direction from the swing center of the manual lever 20. As shown in FIGS. 8-10, the manual lever 20 exercises prescribed functions by assuming three postures relating to respective swing angles.

FIG. 8 shows a state that the input arm 22 is directed obliquely downward. In this state, the manual lever 20 does not interfere with the push-up member 15 at all. A bottom portion of the push-up member 15 is formed with the fitting counterpart portion 156 which projects downward. However, since manual lever 20 is formed with, in the vicinity of its support shaft 21, an interference counterpart portion 25 which is recessed deeply in the swing-radial direction, no interference occurs with the fitting counterpart portion 156.

In the state shown in FIG. 8, the push-up member 15 is located at such a swing position that the cloth presser 11 is located at a pressing position (where the cloth presser 11 is in contact with the top surface of the needle plate 104; the lowest position in a use range (this height is defined as 0 mm)). That is, the push-up member 15 is located at the lowest position. Since the push-up member 15 is not moved downward any further, it does not interfere with the manual lever 20.

The manual lever 20 is configured in such a manner that a corner portion 24 of its swing end portion comes into contact with a support wall surface which serves as a stopper for preventing a further downward swing of the input arm 22.

FIG. 9 shows a state that the input arm 22 is approximately horizontal. In this state, the push-up member 15 is pushed up by the manual lever 20 and the cloth presser 11 is elevated to a presser lift position (the cloth presser 11 is escaped to over the needle plate during a sewing operation; this height is 6 mm).

In this state, a concave fitting portion 23, formed in the vicinity of its swing end portion, of the manual lever 20 is fitted with the fitting counterpart portion 156 of the push-up member 15. Being a downward convex portion, the fitting counterpart portion 156 is fitted into the fitting portion 23 from above.

When the fitting portion 23 is fitted with the fitting counterpart portion 156, swinging of the manual lever 20 is prohibited mainly because the push-up member 15 is pushed downward by the pressing spring 14 via the rod holder 13 and the recessing direction of the fitting portion 23 and the projecting direction of the fitting counterpart portion 156 are swing-radial direction of the manual lever 20. This restricted state can be canceled by pushing up the push-up member 15 against the spring force of the pressing spring 14.

The center G of gravity of the manual lever 20 is located closer to the tip portion of the input arm 22 than the support shaft 21 is. In a state that the manual lever 20 is not bound externally at all, its center G of gravity should be located right under the support shaft 21 and the input arm 22 should be directed downward (rendered approximately vertical). With this position of the center G of gravity defined as its lowest position, the center G of gravity of the manual lever 20 that is oriented as shown in FIG. 9 is located above the lowest position. Thus, when the fitting between the fitting portion 23 and the fitting counterpart portion 156 is canceled by pushing up the push-up member 15, the manual lever 20 is swung because of its own weight in such a direction that the center G of gravity comes closer to the lowest position. That is, once the fitting state is canceled, the manual lever 20 is swung because of its own weight. Even if pushing-up of the push-up member 15 is stopped and then it is lowered, the fitting portion 23 should no longer be fitted with the fitting counterpart portion 156.

In actuality, since the manual lever 20 is formed with the corner portion 24 which serves as the stopper, after the cancellation of the fitting, the manual lever 20 cannot swing until its center G of gravity reaches the lowest position and is stopped at the swing position shown in FIG. 8.

FIG. 10 shows a state that the input arm 22 is directed obliquely upward. In this state, an arc-shaped cam portion 26, adjacent to the fitting portion 23, of the manual lever 20 is in contact with the slant surface 155 of the push-up member 15 and the cloth presser 11 is elevated to a position (height: 7 mm) above the presser lift position. To have the cloth presser 11 escape to above the presser lift position when necessary to do so, the manual lever 20 is manipulated to realize this state.

Instead of the manual lever 20, the knee lift lever may be used which serves to lift up the cloth presser 11 to the presser lift position or a position above it when swung.

[Control System of Sewing Machine]

Figure 11:
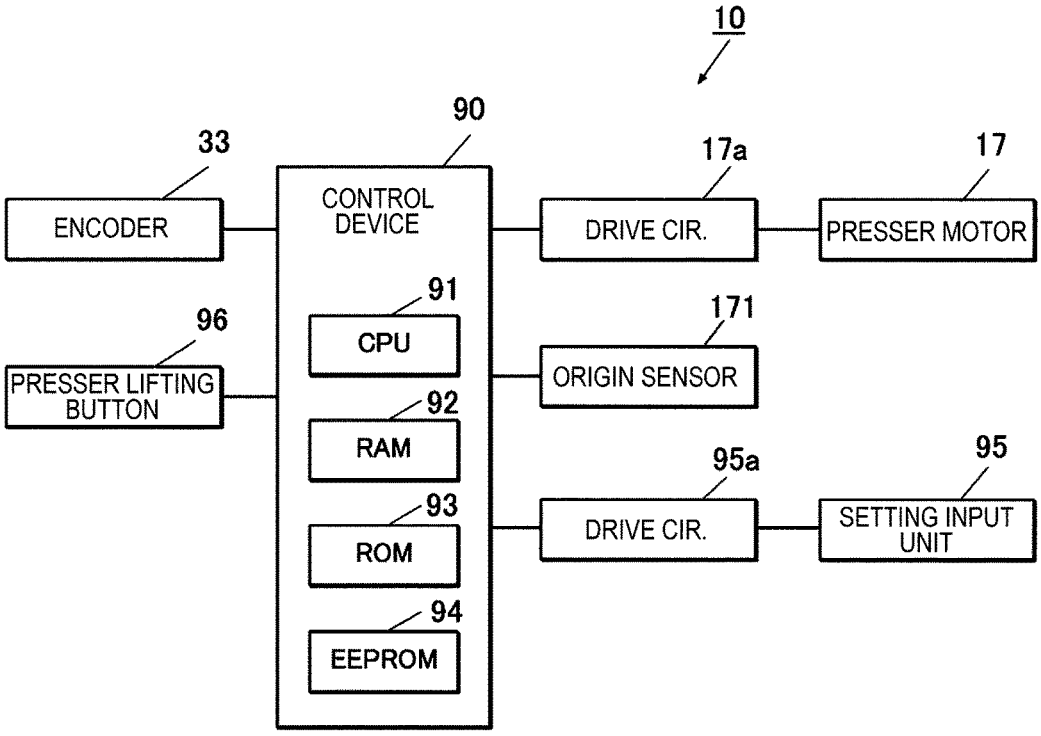
FIG. 11 is a block diagram of a control system of the presser lifting mechanism of the sewing machine.

FIG. 11 is a block diagram of a control system of the presser lifting mechanism 10 of the sewing machine. The presser lifting mechanism 10 of the sewing machine is equipped with a control device 90 for controlling the operation of components of the presser lifting mechanism 10. The presser motor 17 as a drive source for elevation and lowering of the cloth presser 11 and a setting input unit 95 for input of various kinds of settings are connected to the control device 90 via respective drive circuits 17*a* and 95*a*.

Also connected to the control device 90 are an origin sensor 171 for detecting arrival of the presser motor 17 to an origin position, an encoder 33 for detecting the height of the cloth presser 11, and a presser lifting button 96 for commanding elevation or lowering of the cloth presser 11.

The origin position of the presser motor 17 that is detected by the origin sensor 171 coincides with a position of the presser motor 17 that occurs when the cloth presser 11 is located at the pressing position. (Instead of the pressing position of the cloth presser 11, any height position of the cloth presser 11 can be set from the setting input unit 95.) Thus, a small presser lift height can be set from the setting input unit 95. The small presser lift height is a height of the cloth presser 11 that should be set to place the cloth presser 11 a little above the pressing position so that a gap is formed between the needle plate 104 and the bottom surface of the cloth presser 11 in a case of pressing a thick sewing object, for example. The small presser lift height can be set at any height in a range of 0 to 3 mm.

To place the cloth presser 11 at a desired height such as the small presser lift height, the control device 90 controls the presser motor 17 so that the cloth presser 11 is located at the target height while causing the encoder 33 of the presser height detection unit 30 to perform height detection. Alternatively, the control device 90 may perform a drive control on the presser motor 17 to elevate it to the target height after detecting an origin position of the presser motor 17 and placing the cloth presser 11 at the pressing position.

The presser lifting button 96 is a button got commanding elevation or lowering of the cloth presser 11. If the presser lifting button 96 is depressed in a state that the cloth presser 11 is located at the presser lift position, the control device 90 performs an operation of lowering the cloth presser 11 to the pressing position (the small presser lift height if it is set). If the presser lifting button 96 is depressed in a state that the cloth presser 11 is located at the pressing position (the small presser lift height if it is set), the control device 90 performs an operation of elevating the cloth presser 11 to the presser lift position. In each of a lowering operation and an elevation operation, the control device 90 performs a positioning control on the presser motor 17 while monitoring the height of cloth presser 11 detected by the encoder 33.

To perform the above-described controls, the control device 90 is equipped with a CPU 91 for controlling individual components of the presser lifting mechanism 10 of the sewing machine and performing computation processing, a RAM 92 that provides a working area of the CPU 91, a ROM 93 which is stored with programs to be run by the CPU 91, and an EEPROM 94 as a rewritable storage unit for storing data that are used for computation processing.

[Cloth Presser Elevation/Lowering Control in Response to Depression of Presser Lifting Button 96]

Figure 12:
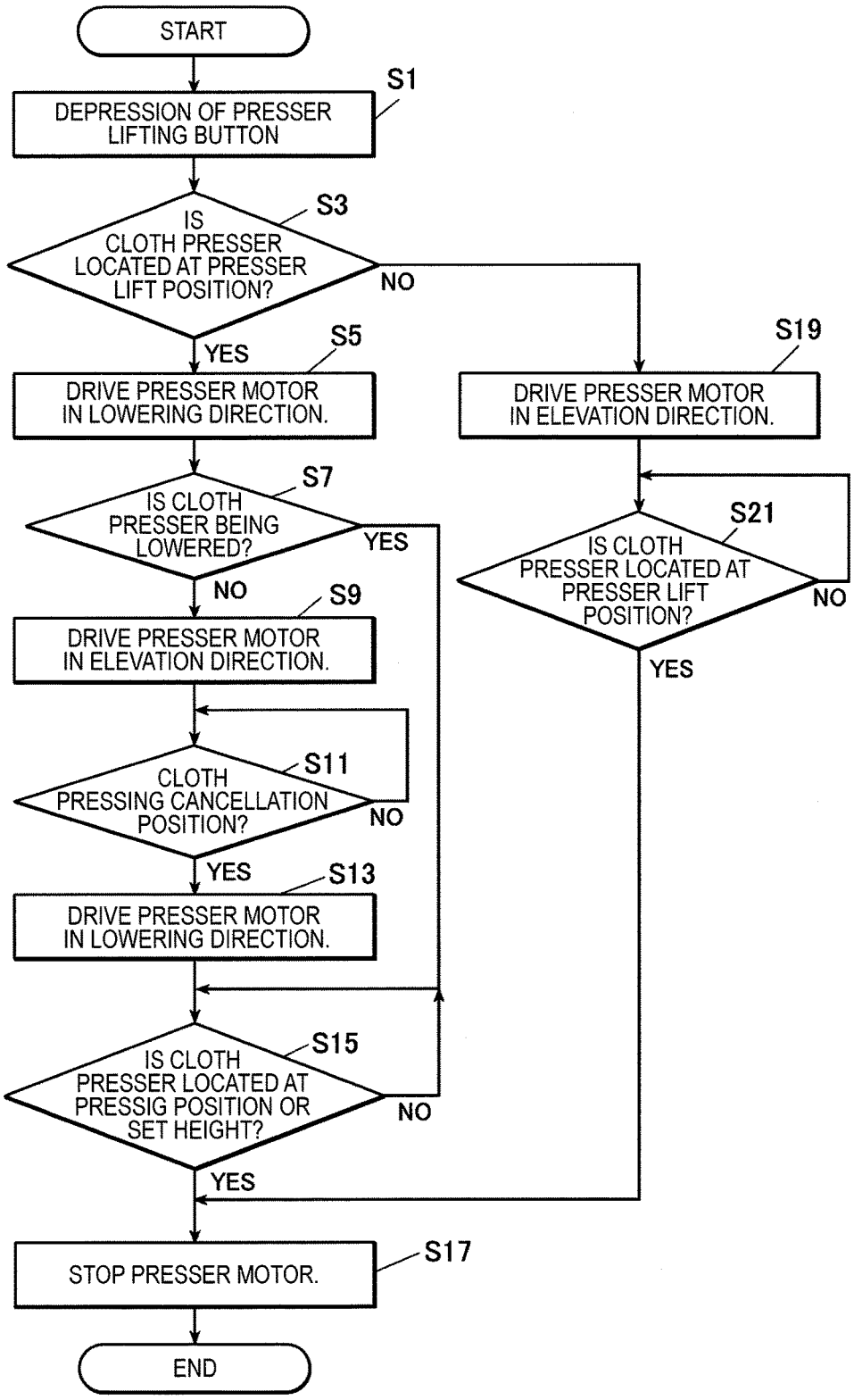
FIG. 12 is a flowchart of a cloth presser elevation/lowering control process that is executed in response to depression of a presser lifting button.

The details of a cloth presser elevation/lowering control in response to depression of the presser lifting button 96 will be described with reference to a flowchart of FIG. 12.

First, when detecting depression of the presser lifting button 96 at step S1, at step S3 the CPU 91 of the control device 90 judges, on the basis of an output of the encoder 33, whether or not the cloth presser 11 is located at the presser lift position.

If it is judged that the cloth presser 11 is located at the presser lift position (S3: yes), at step S5 the CPU 91 drives the presser motor 17 in such a direction as to lower the cloth presser 11.

At step S7, the CPU 91 reads an output of the encoder 33 again and judges whether or not the cloth presser 11 is being lowered. If the cloth presser 11 is held at the presser lift position by means of the manual lever 20 (the state of FIG. 9), the cloth presser 11 is not lowered even if the presser motor 17 is driven in the lowering direction.

Thus, if it is judged on the basis of the output of the encoder 33 that the cloth presser 11 is not being lowered (S7: no), at step S9 the CPU 91 drives the presser motor 17 in such a direction as to elevate the cloth presser 11.

At step S11, the CPU 91 monitors an output of the encoder 33 and judges whether or not the cloth presser 11 has been elevated to a cloth pressing cancellation position, which is a position (height; e.g., 7 mm) that is high enough to cancel fitting between the fitting portion 23 of the manual lever 20 and the fitting counterpart portion 156 of the push-up member 15.

The detection of arrival to the cloth pressing cancellation position means that the push-up member 15 has been moved to a sufficiently high position. Thus, the fitting portion 23 of the manual lever 20 disengages from the fitting counterpart portion 156 of the push-up member 15 and the input arm 22 of the manual lever 20 swings to the position of FIG. 8 because of its own weight.

In this state, at step S13, the CPU 91 drives the presser motor 17 again in such a direction as to lower the cloth presser 11.

At step S15, the CPU 91 monitors an output of the encoder 33 and judges whether or not the cloth presser 11 has been lowered to the pressing position (the small presser lift height if it is set).

If it is judged that the cloth presser 11 has not reached the pressing position (or the small presser lift height) yet (S15: no), the CPU 91 continues to lower the cloth presser 11. If it is judged that cloth presser 11 has reached the pressing position (or small presser lift height) (S15: yes), the CPU 91 stops driving the presser motor 17 at step S17 and finishes the cloth presser elevation/lowering control.

If it is judged that the cloth presser 11 is being lowered (S7: yes), which means that the push-up member 15 is not being held by means of the manual lever 20, the CPU 91 continues to lower the cloth presser 11 until it reaches the pressing position (or small presser lift height). If it is judged that the cloth presser 11 has reached the pressing position (or small presser lift height) (S15: yes), the CPU 91 stops driving the presser motor 17 at step S17 and finishes the cloth presser elevation/lowering control.

On the other hand, if it is judged on the basis of the output of the encoder 33 that the cloth presser 11 is not located at the presser lift position (S3: no), which means that the cloth presser 11 is located at the pressing position (or small presser lift height), at step S19 the CPU 91 drives the presser motor 17 in such a direction as to elevate the cloth presser 11.

At step S21, the CPU 91, on the basis of an output of the encoder 33, whether or not the cloth presser 11 has reached the presser lift position. If it is judged that the cloth presser 11 has not reached the presser lift position yet (S21: no), the CPU 91 continues to elevate the cloth presser 11. If it is judged that the cloth presser 11 has reached the presser lift position (S21: yes), the CPU 91 stops driving the presser motor 17 at step S17 and finishes the cloth presser elevation/lowering control.

[Automatic Presser Lift Cancellation Control]

When the manual lever 20 has been used, it is desirable to return the presser motor 17 to the origin position (i.e., the axis position corresponding to the pressing position of the cloth presser 11) to prevent the presser motor 17 from interfering with a user manipulation. To this end, when a manipulation using the manual lever 20 has been performed, the CPU 91 of the control device 90 performs a following control.

Figure 13:
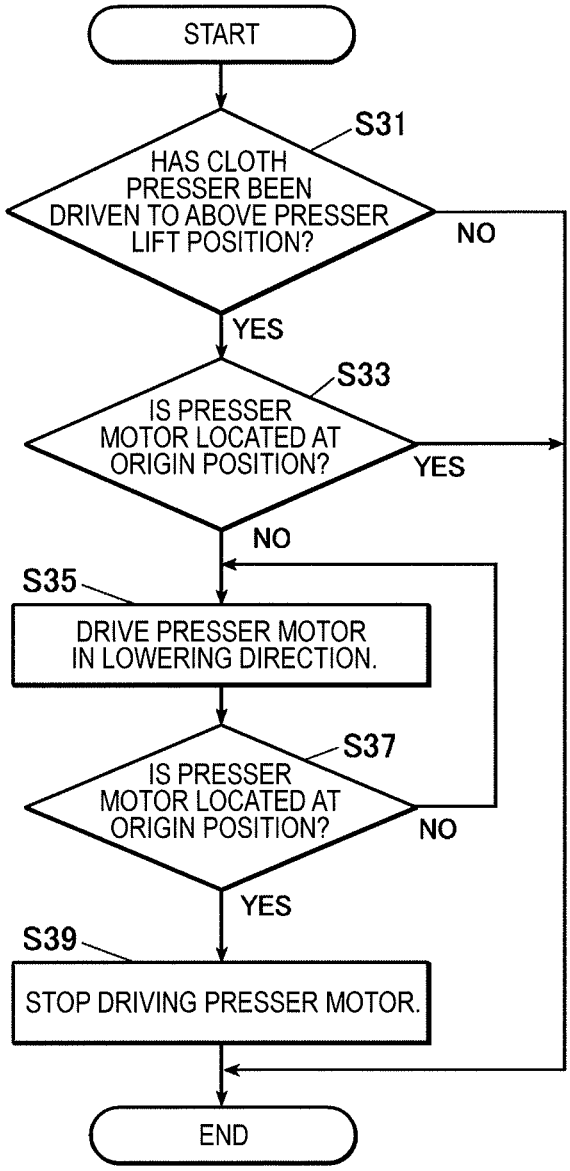
FIG. 13 is a flowchart of an automatic presser lift cancellation control process.

Referring to a flowchart of FIG. 13, a description will be made of the details of a cloth presser elevation/lowering control that is performed after the input arm 22 of the manual lever 20 was swung to assume the posture shown in FIG. 10 (the input arm 22 was directed obliquely upward) from a state that the cloth presser 11 was located at the presser lift position.

This control is performed with an assumption that the cloth presser 11 has been elevated to the presser lift position by the presser motor 17. That is, the CPU 91 of the control device 90 executes the process of FIG. 13 periodically when the CPU 91 has performed a control of driving the presser motor 17 to elevate the cloth presser 11 to the presser lift position.

At step S31, the CPU 91 monitors an output of the encoder 33 and judges whether or not the cloth presser 11 has been elevated from the presser lift position to above it.

If it is judged that the cloth presser 11 has been elevated to above the presser lift position (S31: yes), the CPU 91 judges that the manual lever 20 has been manipulated and then judges at step S33 whether or not the presser motor 17 is located at the origin position. If it is judged that the presser motor 17 is not located at the origin position (S33: no), at step S35 the CPU 91 drives the presser motor 17 in the lowering direction. The CPU 91 continues to drive the presser motor 17 while monitoring outputs of the origin sensor 171 until it detects arrival of the presser motor 17 to the origin position. The CPU 91 stops driving the presser motor 17 at step S39 upon arrival of the presser motor 17 to the origin position (S37: yes). Then the CPU 91 finishes the automatic presser lift cancellation control.

If it is not detected that the cloth presser 11 has been elevated to above the presser lift position (S31: no), the CPU 91 judges that the manual lever 20 was not manipulated and finishes the process.

If it is judged that the presser motor 17 is located at the origin position (S33: yes), the CPU 91 judges that an automatic presser lift cancellation control has already been performed and finishes the process.

When a manipulation on the manual lever 20 by a user of the sewing machine has finished, the manual lever 20 assumes the horizontal posture shown in FIG. 9 because of fitting between the fitting portion 23 of the manual lever 20 and the fitting counterpart portion 156 of the push-up member 15 and the cloth presser 11 itself is placed at the presser lift position by the manual lever 20. Since the presser motor 17 is located at the origin position, the manual lever 20 can be operated manually. Thus, the cloth presser 11 can be lowered to the pressing position by manipulating the manual lever 20 so that its input arm 22 is directed obliquely downward.

The automatic presser lift cancellation control is performed with an assumption that a control of elevating the cloth presser 11 to the presser lift position by the presser motor 17 has been performed, and is not performed if the cloth presser 11 has been lowered to the pressing position by the presser motor 17. This is because in the latter case the presser motor 17 is already located at the origin position and no interference occurs even if the cloth presser 11 is elevated or lowered in this state by the manual lever 20.

Upon completion of the automatic presser lift cancellation control, the CPU 91 executes a process for judging whether or not small presser lift height setting is made. Upon completion of the automatic presser lift cancellation control, the CPU 91 executes, periodically, a process shown in FIG. 14 for judging whether or not to small presser lift height setting is made.

When the manual lever 20 is lowered by a user of the sewing machine so as to assume the posture shown in FIG. 8 after completion of the automatic presser lift cancellation control, the cloth presser 11 is lowered to the pressing position.

At step S41, the CPU 91 monitors an output of the encoder periodically and judges whether or not the cloth presser 11 has been lowered to the pressing position. If lowering of the cloth presser 11 to the pressing position is not detected (S41: no), the process for judgment as to small presser lift height setting is finished.

On the other hand, if lowering of the cloth presser 11 to the pressing position is detected (S41: yes), at step S43 the CPU 91 judges whether or not there exists a set value of small presser lift height setting. If there exists no set value of small presser lift height setting, the process for judgment as to small presser lift height setting is finished.

If there exists a set value of small presser lift height setting (S43: yes), at step S45 the CPU 91 drives the presser motor 17 in the elevation direction. At step S47, the CPU 91 judges whether or not the cloth presser 11 has reached the small presser lift height that is set.

If it is judged that the cloth presser 11 has reached the set small presser lift height (S47: yes), the CPU 91 stops driving the presser motor 17 at step S49 and finishes the control process.

As described above, in the process for judging whether or not small presser lift height setting is made, the cloth presser 11 is positioned at a small presser lift height using detection values of the encoder 33 after the cloth presser 11 has been lowered to the pressing position. This makes it possible to position the cloth presser 11 at the small presser lift height correctly.

The above-described automatic presser lift cancellation control is such as to be performed being triggered by an event that the cloth presser 11 is elevated to above the presser lift position by means of the manual lever 20. The same control as shown in FIG. 13 is performed also when the cloth presser 11 is elevated to above the presser lift position by means of the knee lift lever.

Figure 14:
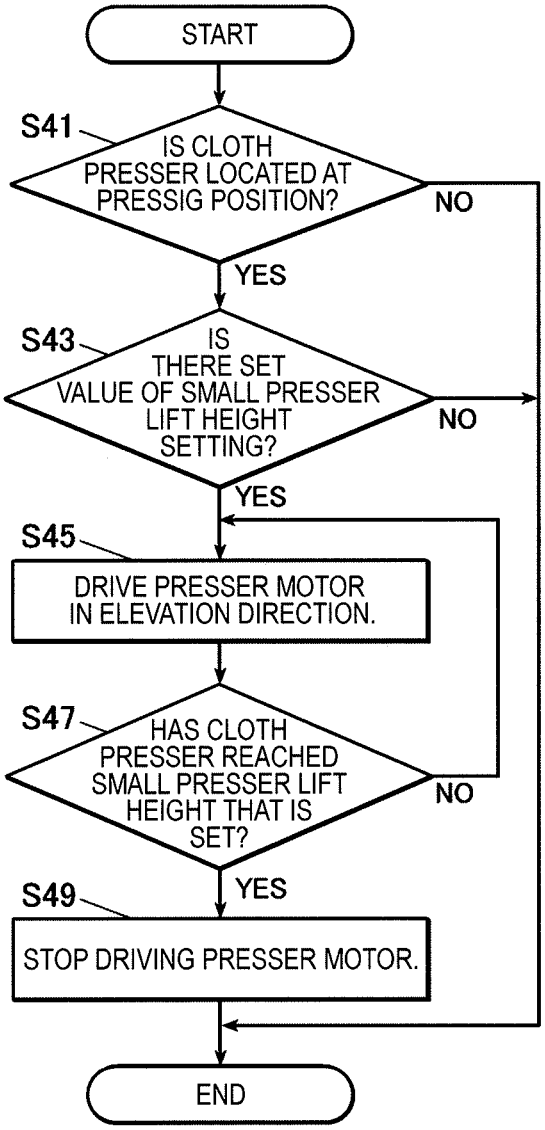
FIG. 14 is a flowchart of a process for judging whether or not small presser lift height setting is made.

In the case of elevation using the knee lift lever, unlike in the case of using the manual lever 20 (see FIG. 9), no structure is provided to hold the cloth presser 11 at the presser lift position. As a result, if a manipulation for elevating the cloth presser 11 using the knee lift lever is stopped, the cloth presser 11 lowers naturally to the pressing position. However, since the process for judging whether or not small presser lift height setting is made which is executed following the automatic presser lift cancellation control is executed being triggered by arrival of the cloth presser 11 to the pressing position, the same process as shown in FIG. 14 is executed also in the case where the knee lift lever is used.

[Technical Advantages of Embodiment of the Invention]

The above-configured presser lifting mechanism 10 of a sewing machine is equipped with the push-up member 15 which is supported by the frame in the machine arm unit 103 so as to be movable in the vertical direction and which is in contact with the rod holder 13 from below and can lift it up. And the presser motor 17 exerts elevating force to the rod holder 13 via the push-up member 15. Thus, the cloth presser 11 can be placed at a desired height by controlling the driving of the presser motor 17. Even if the presser motor 17 is stopped with the cloth presser 11 placed at a target height, because of the presence of the push-up member 15, the rod holder 13 can be moved upward without being bound by the presser motor 17.

If the cloth presser 11 is lifted to above a height obtained by an adjustment using the presser motor 17, the pressing force of the pressing spring 14 acts on it. As a result, pressing pressure can be exerted on a sewing object with the cloth presser 11 located at a desired height. Thus, the sewing machine can feed the sewing object satisfactorily while suppressing a deviation of the sewing object.

Since the manual lever 20 is formed with the fitting portion 23 which is fitted with the fitting counterpart portion 156 formed in the push-up member 15 when the cloth presser 11 is lifted to the presser lift position, the cloth presser 11 can be moved manually to the presser lift position.

Since the fitting counterpart portion 156 and the fitting portion 23 are of a projection-recess structure, the cloth presser 11 can be moved to the pressing position or the small presser lift height by canceling the fitting between the fitting counterpart portion 156 and the fitting portion 23 by swinging the manual lever 20 manually.

The presser lifting mechanism 10 is configured in such manner that the push-up member 15 is also elevated when the cloth presser 11 is elevated to the presser lift position by the manual lever 20. However, since the long hole 572 of the link member 57 allows a swing of the link body 16 and does not transmit the above motion to the cam mechanism 40 and the presser motor 17. Thus, the cloth presser 11 can be elevated manually without interfering with the presser motor 17.

In the presser lifting mechanism 10, the fitting portion 23 of the manual lever 20 is fitted with the fitting counterpart portion 156 of the push-up member 15 from below. The center G of gravity of the manual lever 20 is located above its lowest position when the fitting portion 23 is fitted with the fitting counterpart portion 156, and the manual lever 20 can swing because of its own weight in a direction in which its center G of gravity moves downward when the fitting between the fitting portion 23 and the fitting counterpart portion 156 is canceled because of an upward movement of the push-up member 15. The control device 90 (motor control unit) cancels the fitting between the fitting portion 23 and the fitting counterpart portion 156 by moving the push-up member 15 upward by driving the presser motor 17.

With these measures, the fitting between the fitting portion 23 and the fitting counterpart portion 156 can be canceled by controlling the driving of the presser motor 17. As a result, the amount of manual work can be reduced and the operability can be enhanced.

The presser lifting mechanism 10 is equipped with the presser height detection unit 30 for detecting the height of the cloth presser 11. The control device 90 (motor control unit) performs a manual lever cancellation control (see steps S7 and S11 in FIG. 12) of driving the presser motor 17 in such a direction as to elevate the cloth presser 11 to a position where the fitting between the fitting portion 23 and the fitting counterpart portion 156 is canceled if lowering of the cloth presser 11 is not detected by the presser height detection unit 30 (see step S7 in FIG. 12) when the presser motor 17 is driven in such a direction as to lower the cloth presser 11 (see step S5 in FIG. 12) after the cloth presser 11's being located at the presser lift position was detected by the presser height detection unit 30 (see step S3 in FIG. 12).

With these measures, a state that the cloth presser 11 is held at the presser lift position by means of the manual lever 20 can be detected without the need for providing a sensor for detecting the manipulation position of the manual lever 20 on the side of the manual lever 20. This makes it possible to miniaturize the presser lifting mechanism 10 by reducing the number of components such as sensors and saving the components installation spaces.

In conventional sewing machines, in the case where the cloth presser (11) is elevated to the presser lift position by the presser motor (17) in response to depression of the presser lifting button (96), the position of the cloth presser (11) cannot be changed even if the manual lever (20) is manipulated. In contrast, in the embodiment, a transition can be made from a mode of an automatic presser lifting operation to be made on the cloth presser 11 using the presser motor 17 to a mode of a manual operation using the manual lever 20 or the knee lift lever. Thus, a manipulation for lowering the cloth presser 11 to the pressing position (or small presser lift height) can be made by canceling the automatic presser lifting operation mode, which increases the work efficiency.

[Others]

In the presser lifting mechanism 10, the manual lever 20 is in contact with the arm 151 of the push-up member 15 and serves to elevate the rod holder 13 and the cloth presser 11 to the presser lift position. However, the invention is not limited to this configuration. A configuration is possible in which the arm 151 of the push-up member 15 is removed and, instead, the manual lever 20 exerts elevating force on an arm 131, modified so as to be formed with a slant surface 155 and a fitting counterpart portion 156 having the same structures as of the arm 151, of the rod holder 13.

The control device 90 of the presser lifting mechanism 10 may be replaced by a control device of the sewing machine that incorporates the presser lifting mechanism 10.

The invention claimed is:

1. A presser lifting mechanism of a sewing machine comprising:

a cloth presser;

a pressing rod which is supported by a machine frame so as to be movable in the vertical direction and holds the cloth presser by a bottom end portion thereof;

a rod holder which is fixed to the pressing rod;

a pressing spring a bottom end portion of which is in contact with a top end portion of the rod holder and which pushes the cloth presser downward via the rod holder;

a push-up member through which the pressing rod is inserted so as to be movable in the vertical direction and which is in contact with the rod holder from below and can pushed it up;

a link body which is in contact with a bottom surface of the rod holder and is connected to the push-up member; and a presser motor which is linked to the link body and serves as a drive source for elevation and lowering of the cloth presser, wherein:

the presser motor exerts only elevating force to the rod holder via the link body and causes the push-up member to follow elevation of the rod holder via the link body.

2. The presser lifting mechanism of a sewing machine according to claim 1, further comprising:

a motor control unit which controls the presser motor;

a presser height detection unit which detects a height of the cloth presser from a top surface of a needle plate on which a sewing object is placed; and a setting input unit which sets a height of the cloth presser from the top surface of the needle plate, wherein:

the motor control unit controls the presser motor so that the cloth presser comes to be located at the height that is set by the setting input unit.

3. The presser lifting mechanism of a sewing machine according to claim 2, wherein the setting input unit sets a small presser lift height at which a gap is formed between the cloth presser and the top surface of the needle plate.

4. The presser lifting mechanism of a sewing machine according to claim 2, wherein the presser height detection unit comprises:

a detection member which is supported by the push-up member;

a detection gear which rotates as the detection member is moved in the vertical direction; and an encoder which detects a rotation mount of the detection gear.

5. The presser lifting mechanism of a sewing machine according to claim 2, further comprising a manual lever which lifts up the cloth presser when swing-manipulated, wherein:

the manual lever is foamed with a fitting portion which is fitted with a fitting counterpart portion formed in the rod holder or the push-up member when the cloth presser is lifted up to a presser lift position escape which is an escape position of the cloth presser above the needle plate.

6. The presser lifting mechanism of a sewing machine according to claim 5, wherein:

the fitting portion of the manual lever is fitted with the fitting counterpart portion of the rod holder or the push-up member from below;

the manual lever can swing because of its own weight in a direction in which its center of gravity moves downward when the fitting between the fitting portion and the fitting counterpart portion is canceled because of an upward movement of the rod holder or the push-up member; and the motor control unit performs a control of canceling the fitting between the fitting portion and the fitting counterpart portion by moving the push-up member upward by driving the presser motor.

7. The presser lifting mechanism of a sewing machine according to claim 6, wherein the motor control unit performs a manual lever cancellation control of driving the presser motor in such a direction as to elevate the cloth presser to a position where the fitting between the fitting portion and the fitting counterpart portion is canceled if lowering of the cloth presser is not detected by the presser height detection unit when the presser motor is driven in such a direction as to lower the cloth presser after the cloth presser's being located at the presser lift position was detected by the presser height detection unit.

8. The presser lifting mechanism of a sewing machine according to claim 5, further comprising an origin sensor which detects arrival or presence of the presser motor to or at an origin position where the cloth presser is located at a pressing position, wherein:

the motor control unit performs an automatic presser lift cancellation control of returning the presser motor to the origin position by driving it in such a direction as to lower the cloth presser if the presser height detection unit detects that the cloth presser is located above the presser lift position and the origin sensor detects that the presser motor is not located at the origin point.

9. The presser lifting mechanism of a sewing machine according to claim 2, further comprising:

a knee lift lever which lifts up the cloth presser when swing-manipulated; and an origin sensor which detects arrival or presence of the presser motor to or at an origin position where the cloth presser is located at a pressing position, wherein:

the motor control unit performs an automatic presser lift cancellation control of returning the presser motor to the origin position by driving it in such a direction as to lower the cloth presser if the presser height detection unit detects that the cloth presser is located above the presser lift position and the origin sensor detects that the presser motor is not located at the origin point.

* * * * *